US009726171B2

(12) United States Patent
Ito

(10) Patent No.: US 9,726,171 B2
(45) Date of Patent: Aug. 8, 2017

(54) ROTARY ACTUATOR

(71) Applicant: NABTESCO CORPORATION, Tokyo (JP)

(72) Inventor: Koji Ito, Gifu (JP)

(73) Assignee: NABTESCO CORPORATION, Tokyo (JP)

( * ) Notice: Subject to any disclaimer, the term of this patent is extended or adjusted under 35 U.S.C. 154(b) by 474 days.

(21) Appl. No.: 13/686,423

(22) Filed: Nov. 27, 2012

(65) Prior Publication Data

US 2013/0133513 A1 May 30, 2013

(30) Foreign Application Priority Data

Nov. 28, 2011 (JP) ..... 2011-258508

(51) Int. Cl.
*F01C 20/02* (2006.01)
*F04C 9/00* (2006.01)
(Continued)

(52) U.S. Cl.
CPC ..... *F04C 9/00* (2013.01); *F01C 9/002* (2013.01); *F01C 11/002* (2013.01); *F01C 20/02* (2013.01);
(Continued)

(58) Field of Classification Search
CPC ..... F01C 9/002; F01C 11/002; F01C 21/08; F01C 9/00; F01C 20/02; F04C 9/002; F15B 15/125
(Continued)

(56) References Cited

U.S. PATENT DOCUMENTS 1,892,187 A * 12/1932 Drennon ..... 416/157 R
2,753,850 A * 7/1956 Baumgartner ..... 91/290
(Continued)

FOREIGN PATENT DOCUMENTS

DE 871557 C * 3/1953 ..... F15B 15/125
JP S40-32252 U 11/1965
(Continued)

OTHER PUBLICATIONS

An Office Action; "Notice of Reason for Rejection," issued by the Japanese Patent Office on Aug. 25, 2015, which corresponds to Japanese Patent Application No. 2011-258508 and is related to U.S. Appl. No. 13/686,423; with English language translation.
(Continued)

*Primary Examiner* — Eric Keasel
*Assistant Examiner* — Abiy Teka
(74) *Attorney, Agent, or Firm* — Studebaker & Brackett PC

(57) ABSTRACT

A cylinder is installed within a case, and an output shaft and an arm that is integrated thereto and extends in a radial direction are installed within the cylinder. A piston extending in an arc slides and is displaced in a circumferential direction of the cylinder within the cylinder. One end portion of the piston is rotatably connected to the arm. The cylinder is internally provided with a first pressure chamber in which the arm is housed and a second pressure chamber in which the other end portion of the arm is slidably installed. A pressure medium is fed into one of the first and second pressure chambers and discharged from the other, and the output shaft pivots in a rotational direction.

7 Claims, 8 Drawing Sheets

(51) Int. Cl.

| | |
|---|---|
| ***F01C 9/00*** | (2006.01) |
| ***F01C 11/00*** | (2006.01) |
| ***F01C 21/08*** | (2006.01) |
| *F04C 15/00* | (2006.01) |

(52) U.S. Cl.
CPC ..... *F01C 21/08* (2013.01); *F04C 15/0076* (2013.01); *F04C 2240/30* (2013.01); *F04C 2240/60* (2013.01)

(58) Field of Classification Search
USPC ..... 92/54, 120, 122, 129
See application file for complete search history.

(56) References Cited

U.S. PATENT DOCUMENTS

| | | | | |
|---|---|---|---|---|
| 2,808,809 | A * | 10/1957 | Tenfjord | 91/443 |
| 3,731,597 | A * | 5/1973 | Payne | 92/120 |
| 3,822,971 | A * | 7/1974 | Chahrouri | 418/36 |
| 3,938,480 | A * | 2/1976 | Yanda | 123/43 B |
| 4,455,125 | A * | 6/1984 | Irwin | 417/244 |
| 5,199,391 | A * | 4/1993 | Kovalenko | 123/43 B |
| 5,601,165 | A | 2/1997 | Oppitz et al. | |
| 6,895,922 | B1 * | 5/2005 | Stoughton et al. | 123/241 |
| 2003/0066506 | A1 * | 4/2003 | Masters | 123/245 |
| 2013/0104729 | A1 * | 5/2013 | Ito et al. | 92/32 |

FOREIGN PATENT DOCUMENTS

| | | | |
|---|---|---|---|
| JP | H04-357308 | A | 12/1992 |
| JP | H11-193772 | A | 7/1999 |

OTHER PUBLICATIONS

The extended European search report issued by the European Patent Office on May 27, 2016, which corresponds to European Patent Application No. 12194388.0-1608 and is related to U.S. Appl. No. 13/686,423; 7pp.

* cited by examiner

ROTARY ACTUATOR

CROSS-REFERENCE TO RELATED APPLICATION

This application claims priority to Japanese Patent Application No. 2011-258508. The entire disclosure of Japanese Patent Application No. 2011-258508 is hereby incorporated herein by reference.

BACKGROUND OF THE INVENTION

Field of the Invention

The present invention relates to rotary actuators that output driving torque as a result of output shafts pivoting in a rotational direction due to action of a pressure medium.

Description of the Related Art

A rotary actuator having such a configuration as the one disclosed in U.S. Pat. No. 5,601,165 is known as one of the rotary actuators that output driving torque as a result of an output shaft pivoting in a rotational direction due to action of a pressure fluid serving as a pressure medium.

In the rotary actuator disclosed in U.S. Pat. No. 5,601,165, ribs are provided within a cylinder as an integral unit, and vanes are provided to an output shaft rotatably installed within the cylinder. Both ends of the cylinder are provided with end caps. The ribs and the inner wall surface of the cylinder, as well as the vanes and the outer wall surface of the output shaft form pressure chambers. Adjoining pressure chambers are alternatively supplied with a pressure fluid, the output shaft thereby pivots in a rotational direction due to action of the pressure fluid, and, as a result, driving torque is output.

In the above rotary actuator, seals are inserted into grooves provided on the ribs and the vanes. The seals inserted into the ribs are pressed against the outer wall surface of the output shaft, and the seals inserted into the vanes are pressed against the inner wall surface of the cylinder. Thus the adjoining pressure chambers are sealed against each other. The pressure chambers are also sealed against each other by means of gaskets between the end caps and the output shaft, as well as between the end caps and the vanes.

SUMMARY OF THE INVENTION

In a conventional general rotary actuator such as the one disclosed in U.S. Pat. No. 5,601,165, a rotary sliding portion between the rotary output shaft and the ribs provided on the cylinder is sealed by the seals inserted into the ribs. A rotary sliding portion between the vanes provided on the rotary output shaft and the cylinder is also sealed by the seals inserted into the vanes. Furthermore, rotary sliding portions between the rotary output shaft and the end caps, as well as between the vane and the end caps are also sealed by the gaskets.

Unfortunately, it is difficult to suppress leakage of the pressure fluid in the rotary sliding portions by means of the seals. In the conventional rotary actuators such as the one disclosed in U.S. Pat. No. 5,601,165, leakage occurs from the seals or the gaskets in many cases under the current circumstances. Therefore, the pressure fluid often leaks within the rotary actuator. Moreover, the conventional rotary actuators have a structure in which the seals are inserted into the grooves in the ribs or the vanes, the problem of leakage between the grooves and the seals also arises. Furthermore, since each seal inserted into the groove has corner sections, it is particularly difficult to maintain adhesion to the surface relative to which the seal slides, in those corner sections and in the vicinity thereof, which makes it difficult to suppress leakage. Therefore, the pressure fluid leaks more often within the rotary actuator.

In addition, the conventional rotary actuators need high-pressure rotary seals that are used in the rotary sliding portions and pressed with high pressure against the surface relative to which the seals slide. Such seals are therefore different from statically used seals or those for use in linear sliding portions, and another problem arises of significantly shorter duration of the seals during which sealing characteristics intended by the design can be maintained. For that reason, a rotary actuator whose structure does not need the high-pressure rotary seals or is able to significantly reduce the number of the high-pressure rotary seals is desired to be realized.

In light of the foregoing situation, it is an object of the present invention to provide a rotary actuator capable of reducing internal leakage of the pressure medium, and whose structure does not need the high-pressure rotary seals or is able to significantly reduce the number of the high-pressure rotary seals.

To achieve the above-stated object, the rotary actuator according to a first feature of the present invention is a rotary actuator that outputs driving torque as a result of an output shaft pivoting in a rotational direction due to action of a pressure medium, the rotary actuator comprising: a case; a cylinder that is installed within the case and internally has a hollow space; an output shaft that is rotatably supported with respect to the case, has an axial direction parallel to an axial direction of the cylinder, and is installed in the hollow space; an arm that is integrated with, or fixed to, the output shaft, and extends in a radial direction of the cylinder; and a piston that has a portion extending in an arc, and is installed within the cylinder and supported so as to be able to slide and be displaced with respect to the cylinder along a circumferential direction of the cylinder, wherein one end portion of the piston is rotatably connected to the arm, the cylinder is internally provided with a first pressure chamber in which the output shaft and the arm are housed, and a second pressure chamber that is defined by the cylinder and the piston and in which another end portion of the piston that is located opposite from the end portion thereof connected to the arm is slidably installed, and as a result of a pressure medium being fed into one of the first pressure chamber and the second pressure chamber and discharged from the other, the arm is displaced in the circumferential direction of the cylinder, and the output shaft pivots in the rotational direction.

With this configuration, inside the cylinder installed within the case, the pressure medium is fed into one of the first and second pressure chambers and discharged from the other, and the piston thereby slides and is displaced in the circumferential direction of the cylinder. As a result of the arm to which the piston is rotatably connected being driven by the piston, the output shaft pivots with the arm in a rotational direction. Thus the driving torque of the rotary actuator is output. As described above, with the rotary actuator having the above configuration, the first pressure chamber on one end side of the piston that slides with respect to the cylinder and the second pressure chamber on the other end are defined within the cylinder. Thus, such a structure provided with pressure chambers defined by an output shaft, vanes, a cylinder, ribs, and end caps, as the structure of the conventional rotary actuators, is not necessary. That is, the rotary actuator of the above configuration does not need rotary sliding portions between the output shaft and the ribs provided to the cylinder, between the cylinder and vanes provided to the rotary output shaft, and between the rotary output shaft with the vanes and end caps. Accordingly, with the above configuration, internal leakage of the pressure medium within the rotary actuator can be reduced. In addition, the rotary actuator having the above configuration does not need, or is able to greatly reduce the number of, the high-pressure rotary seals that are used in the rotary sliding portions and pressed with high pressure against the surface relative to which the seals slide.

Consequently, with the above configuration, it is possible to provide the rotary actuator capable of reducing internal leakage of the pressure medium, and whose structure does not need the high-pressure rotary seals or is able to significantly reduce the number of the high-pressure rotary seals.

Note that with the above configuration, the piston that drives, via the arm, the output shaft is rotatably connected to the arm. Therefore, even if an external load acts on the output shaft, the arm can be prevented from separating from the piston. Consequently, in the case where a servo control mechanism is built for control of the rotational position of the output shaft driven by the piston that is displaced due to feed and discharge of the pressure oil into/from the first and second pressure chambers, reduction in the responsiveness of this servo mechanism can be suppressed. That is, even if responsiveness of the above servo mechanism is increased, momentary incapability to control the rotational position mentioned above is prevented.

The rotary actuator according to a second feature of the present invention is the rotary actuator of the first feature, wherein the cylinder includes a plurality of cylinder blocks each formed in a divided state, the cylinder is integrally assembled by putting together the plurality of cylinder blocks along the axial direction of the cylinder, the cylinder is provided with a piston chamber that houses the piston supported so as to be able to slide and be displaced with respect to the cylinder, and the piston chamber is defined between the cylinder blocks adjoining in the axial direction of the cylinder.

With this configuration, the cylinder is assembled by the plurality of cylinder blocks being put together in the axial direction of the cylinder, and the piston chamber is defined between the adjoining cylinder blocks. Therefore, when the piston chamber is formed, a semicircular groove is formed on each cylinder block, and these grooves are combined to constitute the piston chamber. It is thus possible to easily form the piston chamber for housing the piston that slides and is displaced in the circumferential direction of the cylinder, and to easily manufacture the cylinder.

The rotary actuator according to a third feature of the present invention is the rotary actuator of the first feature, wherein a plurality of the pistons are provided, and the plurality of pistons are arranged in line along an axial direction of the output shaft.

With this configuration, the output shaft is driven via the arm by the plurality of pistons installed in line along the axial direction of the output shaft. Therefore, it is possible to output a larger amount of driving torque with a compact structure, without increasing the size of the cylinder in its radial direction.

The rotary actuator according to a fourth feature of the present invention is the rotary actuator of the first feature, wherein a plurality of the arms are provided so as to extend in the radial direction of the cylinder from a plurality of positions on the output shaft.

With this configuration, the arms are provided so as to extend from the plurality of positions on the output shaft in the radial direction. In the case where the plurality of pistons for driving, via the arms, the output shaft to rotate are provided, the design associated with the installation position thereof can be made more freely. Note that the arms may be provided so as to extend in the radial direction of the cylinder from the plurality of positions in the axial direction of the output shaft, for example. Furthermore, the arms may be provided so as to extend in radial directions of the cylinder from the plurality of positions on the output shaft, forming different angles in the circumferential direction of the cylinder.

The rotary actuator according to a fifth feature of the present invention is the rotary actuator of the fourth feature, wherein the plurality of arms are provided to extend in the radial direction of the cylinder along the same plane perpendicular to the axial direction of the output shaft, a piston unit constituted by the plurality of pistons installed so as to extend in the circumferential direction of the cylinder along the same plane is provided, and the pistons in the piston unit are rotatably connected to the respective arms.

With this configuration, the output shaft can be driven to rotate by the plurality of pistons in the piston unit that are installed along the same plane perpendicular to the axial direction of the output shaft. Therefore, it is possible to output a lager amount of driving torque while preventing the rotary actuator from becoming longer in the axial direction of the cylinder, and also preventing the rotary actuator from becoming larger in the radial direction of the cylinder. For example, in the case where the piston unit is constituted by two pistons, it is possible to double the output of the rotary actuator without increasing its length in the axial direction and the size in the radial direction.

The rotary actuator according to a sixth feature of the present invention is the rotary actuator of the fifth feature, wherein a plurality of the piston units are provided, and the plurality of piston units are arranged in line along the axial direction of the output shaft.

With this configuration, the output shaft is driven via the arms by the plurality of piston units installed in line along the axial direction of the output shaft. Therefore, it is possible to further output a larger amount of driving torque with a compact structure, without increasing the size of the cylinder in its radial direction.

The rotary actuator according to a seventh feature of the present invention is the rotary actuator of the first feature, wherein the cylinder is provided with a piston chamber that houses the piston supported so as to be able to slide and be displaced with respect to the cylinder, and the piston chamber is defined by a tubular hollow member that is installed in a main body of the cylinder and extends in an arc.

With this configuration, the member for defining the piston chamber is constituted by the tubular hollow member provided separately from the main body of the cylinder. It is therefore possible to easily form the piston chamber having a structure in which the surface relative to which the pistons slide is seamless, and internal leakage can be further reduced.

It should be appreciated that the above and other objects, features and advantages of the present invention will become apparent from the following description taken in conjunction with the accompanying drawings.

DETAILED DESCRIPTION OF THE INVENTION

An embodiment for implementing the present invention will be hereinafter described with reference to the drawings. Note that the present invention can be applied widely to rotary actuators that output driving torque as a result of output shafts thereof pivoting in a rotational direction due to action of a pressure medium.

Figure 1:
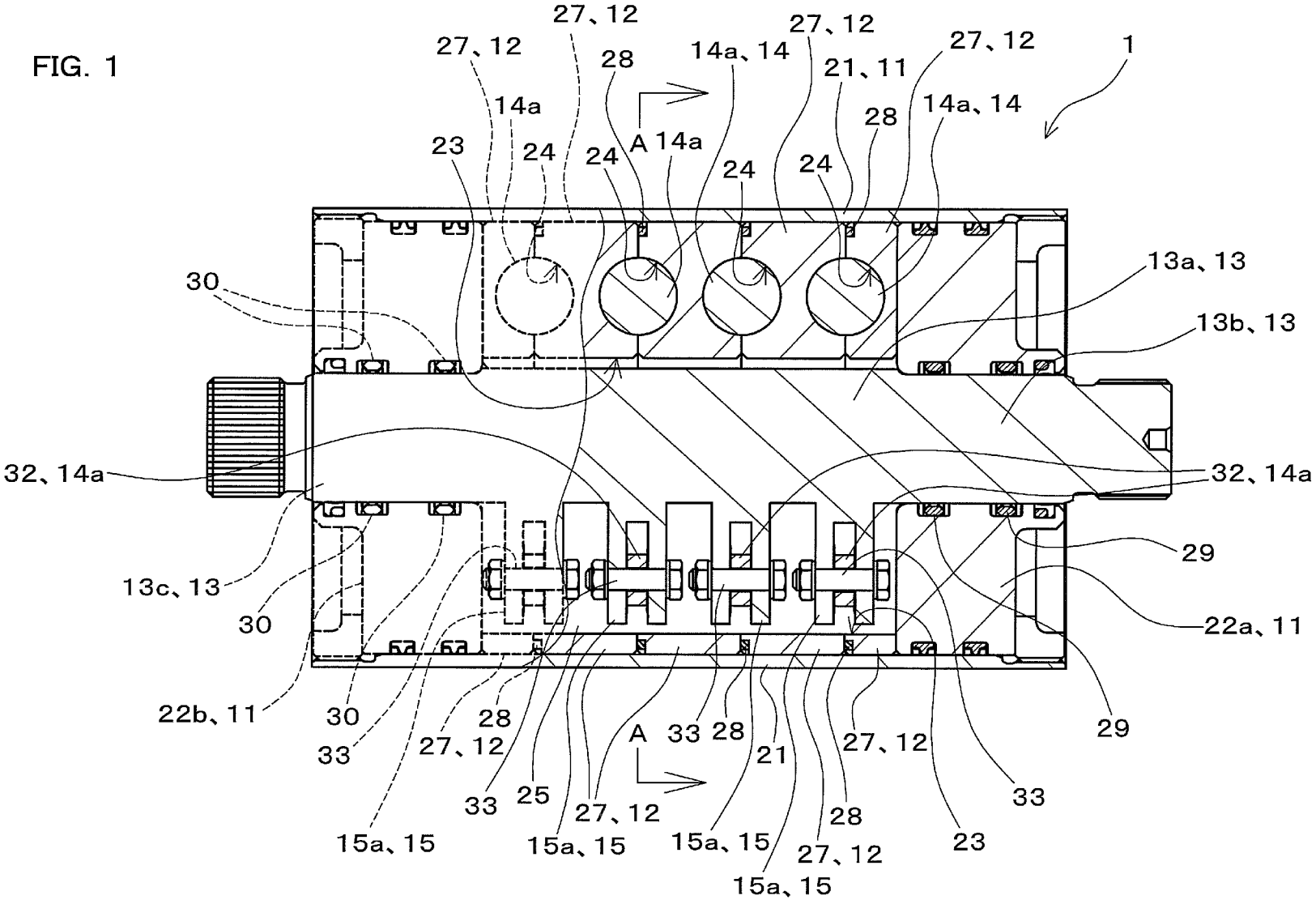
FIG. 1 is a diagram showing a rotary actuator according to one embodiment of the present invention including a partial cross-sectional view thereof, viewed from a direction perpendicular to an axial direction thereof.
Figure 2:
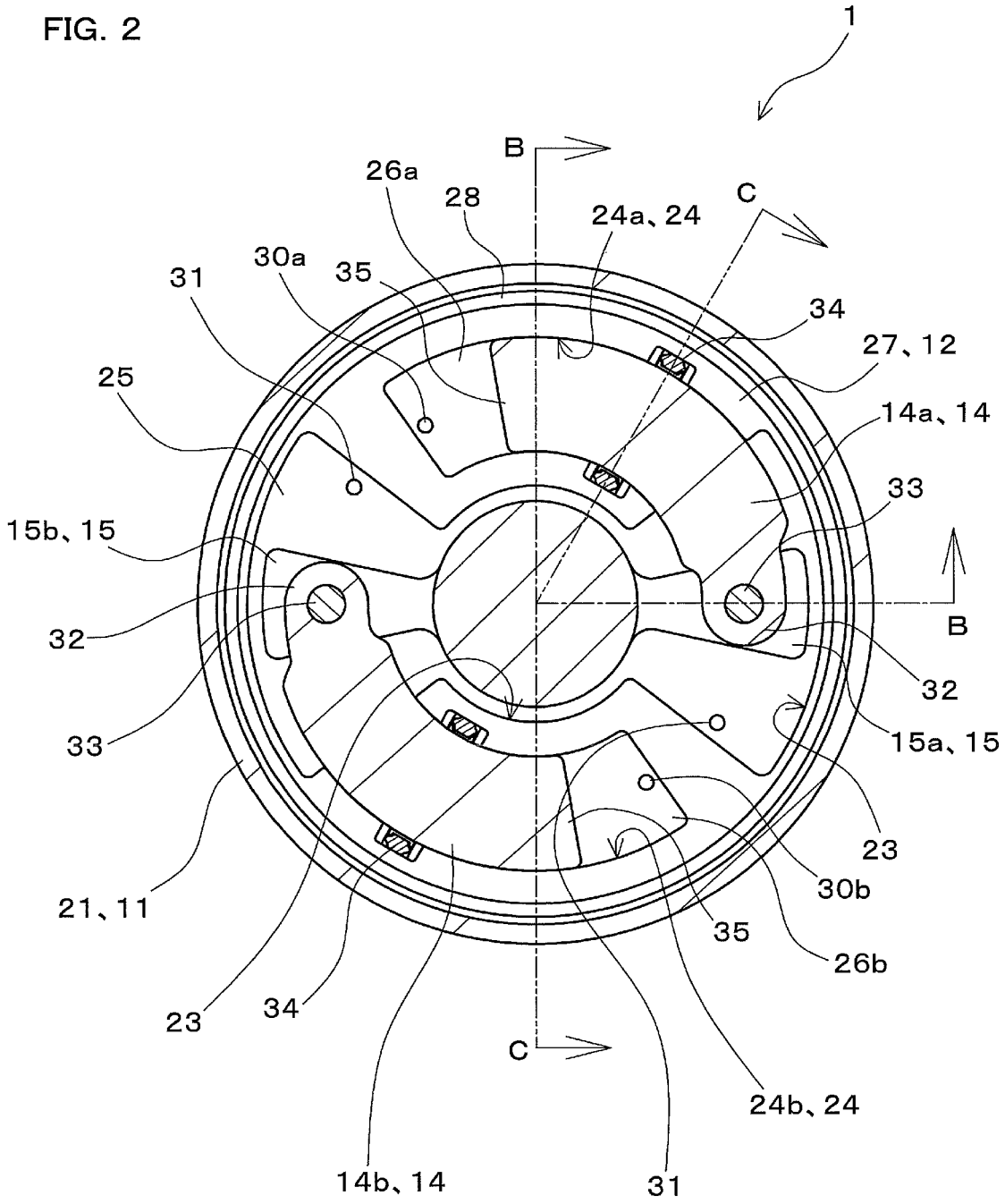
FIG. 2 is a cross-sectional view of the rotary actuator shown in FIG. 1, viewed along arrows A-A.
Figure 3:
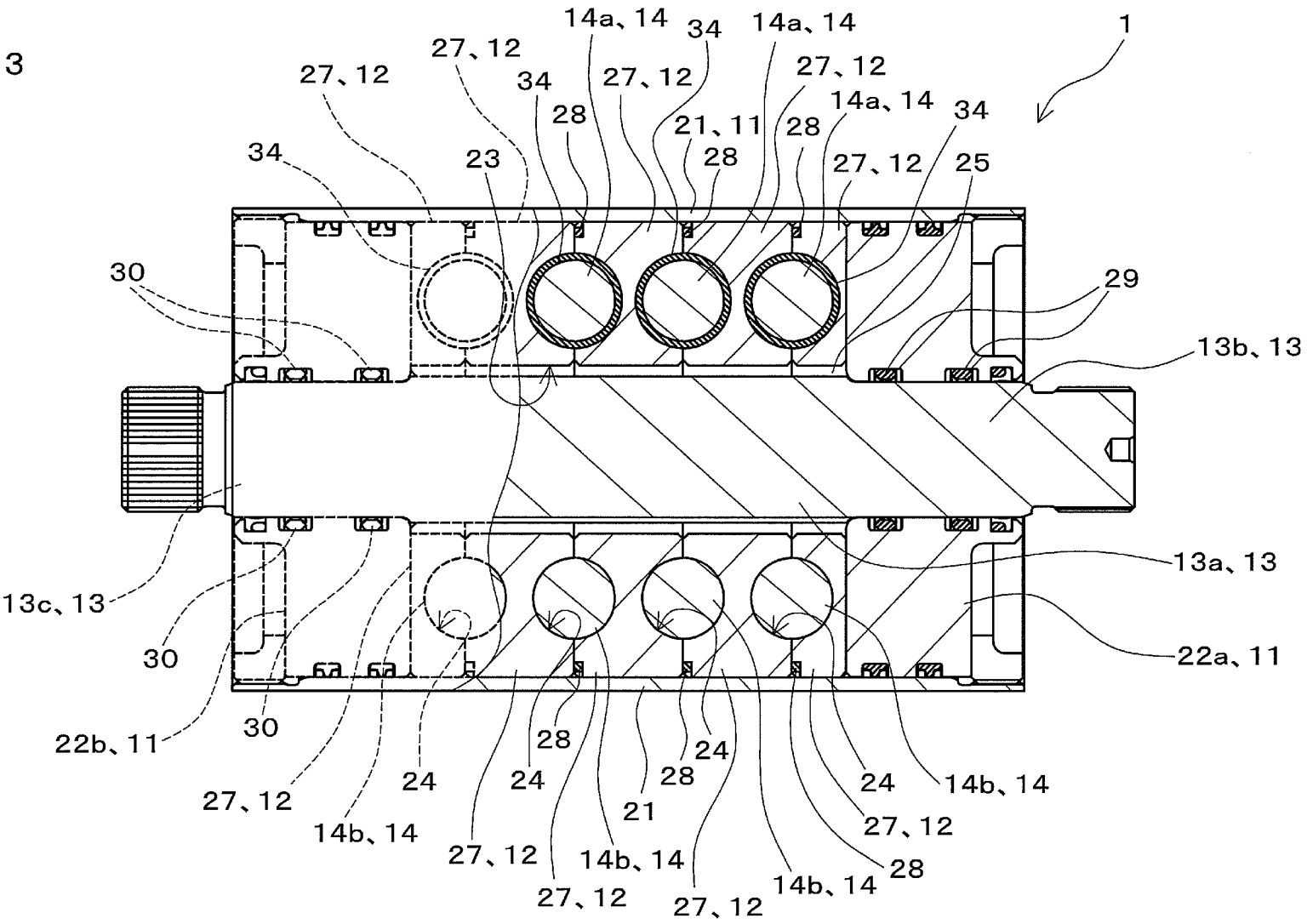
FIG. 3 is a cross-sectional view of the rotary actuator shown in FIG. 2, viewed along arrows C-C.

FIG. 1 is a diagram showing a rotary actuator 1 according to one embodiment of the present invention including a partial cross-sectional view thereof, viewed from a direction perpendicular to an axial direction thereof. FIG. 2 is a cross-sectional view of the rotary actuator 1, viewed along arrows A-A in FIG. 1. Note that FIG. 1 includes the cross section viewed along arrows B-B indicated by dashed lines in FIG. 2. FIG. 3 is a diagram showing the rotary actuator 1 including a cross-sectional view thereof, viewed along arrows C-C indicated by two-dot chain lines in FIG. 2.

The rotary actuator 1 shown in FIGS. 1 to 3 is provided as an actuator that outputs driving torque as a result of an output shaft 13 pivoting in a rotational direction around its shaft center due to action of a pressure medium. The pressure medium can be various kinds of pressure fluid such as compressed air or pressure oil. The pressure medium may be in the form of powder particle made of a metal material, a resin material, a ceramic material, a composite material of those materials, or the like. Note that the present embodiment will be described, taking, as an example, a mode of using pressure oil as the pressure medium.

As shown in FIGS. 1 to 3, the rotary actuator 1 is provided with a case 11, a cylinder 12, an output shaft 13, a plurality of piston units 14, a plurality of arm units 15, and so on. Note that the case 11, the cylinder 12, the output shaft 13, the plurality of piston units 14, and the plurality of arm units 15 are mainly made of, for example, a metal material such as stainless steel, titanium alloy, or aluminum alloy.

The case 11 has a case main body portion 21 and a pair of lid portions (22*a*, 22*b*). The case main body portion 21 is provided as, for example, a cylindrical member, which is internally hollow and open at its both ends. The lid portions 22*a* and 22*b* are respectively inserted into, and thus fixed to the open ends. This pair of lid portions (22*a*, 22*b*) close the both ends of the case main body portion 21. Each lid portion (22*a*, 22*b*) is provided as, for example, a disk-shaped member. In addition, each lid portion (22*a*, 22*b*) has a through hole in its center through which the ends of the output shaft 13, which will be described later, pass through and protrude.

Figure 4:
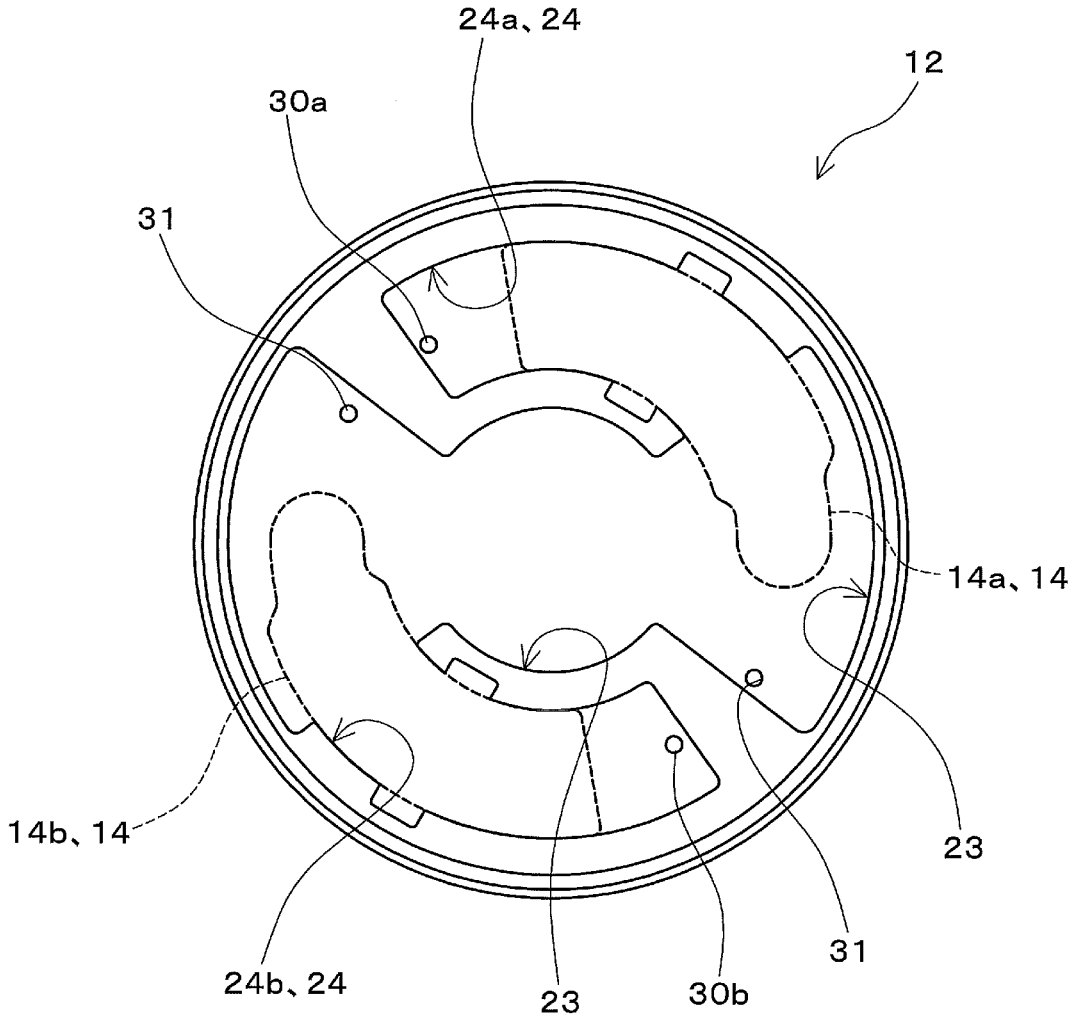
FIG. 4 is a cross-sectional view of a cylinder in the rotary actuator shown in FIG. 2.

FIG. 4 is a cross-sectional view of the cylinder 12 showing the cross section corresponding to FIG. 2. Note that in FIG. 4, the piston unit 14 is also shown by two-dot chain lines. As shown in FIGS. 1 to 4, the cylinder 12 has a cylindrical structure installed within the case 11 and internally provided with a hollow space 23. The hollow space 23 is provided as a hollow space extending along the axial direction of the cylinder 12, and the output shaft 13, which will be described later, is installed therein. Note that the axial direction of the cylinder 12, the axial direction of the actuator 1 that is a longitudinal direction of the actuator 1, the cylinder axial direction of the case 11, and the axial direction of the output shaft 13 are configured as directions parallel to one another, and may be configured as the same direction.

Within the cylinder 12 a plurality of piston chambers 24 are provided, each being a long hole extending in an arc along the circumferential direction of the cylinder 12. The plurality of piston chamber 24 are provided, each extending in the circumferential direction of the cylinder 12 along the same plane perpendicular to the axial direction of the cylinder 12. Note that in the present embodiment, two piston chambers 24 (24*a*, 24*b*) are provided along the same plane perpendicular to the axial direction of the cylinder 12 so as to extend in the circumferential direction of the cylinder 12.

Furthermore, in the cylinder 12 pairs of piston chambers 24 (24*a*, 24*b*) provided along the circumferential direction of the cylinder 12 are arranged in line along the axial direction of the cylinder 12. That is, the pairs of piston chambers 24 (24*a*, 24*b*) are provided along the respective planes perpendicular to the axial direction of the cylinder 12 so as to extend along the circumferential direction of the cylinder 12.

Each piston chamber 24 is provided as a hole that communicates with the hollow space 23 within the cylinder 12. The piston chamber 24 is defined so that movement of the pressure oil between the piston chamber 24 and the hollow space 23 is regulated by arc pistons (14*a*, 14*b*) in the piston unit 14, which will be described later. Note that the piston chamber 24*a* is defined so that movement of the pressure oil between the piston chamber 24*a* and the hollow space 23 is regulated by the arc piston 14*a*. Meanwhile, the piston chamber 24*b* is defined so that movement of the pressure oil between the piston chamber 24*b* and the hollow space 23 is regulated by the arc piston 14*b*. Note that in the piston chamber 24*a*, a pressure chamber 26*a*, which will be described later, is defined by the arc piston 14*a*. In the piston chamber 24*b*, a pressure chamber 26*b*, which will be described later, is defined by the arc piston 14*b*.

Further, the cylinder 12 is provided with a plurality of cylinder blocks 27 formed in a divided state. Each cylinder block 27 is provided as a cylindrical member whose length in the axial direction is short. The cylinder blocks 27 are put together along the axial direction of the cylinder 12 within the case main body portion 21 of the case 11, and thus the cylinder 12 is integrally assembled.

Further, each cylinder block 27 is provided with a region formed as a through hole that constitutes part of the hollow space 23, and grooves having a semicircular cross section and extending in an arc along the circumferential direction of the cylinder 12. Each cylinder block 27 installed at a position other than both ends in the axial direction of the cylinder 12 is provided with those grooves on both end faces in the axial direction. Meanwhile, each of the cylinder blocks 27 installed at both ends in the axial direction of the cylinder 12 is provided with the groove on one end face in the axial direction. Those grooves are put together so as to face each other to form a circular cross section between the cylinder blocks 27 adjoining in the axial direction of the cylinder 12, thereby defining the piston chambers 24.

Further, in the cylinder blocks 27 adjoining in the axial direction of the cylinder 12, a fitting face on which the above-mentioned grooves each having a semicircular cross section are formed and put together is formed as a plain face so that the cylinder blocks 27 are brought into close contact with each other. Thus leakage of the pressure oil between the adjoining cylinder blocks 27 is sufficiently prevented. Note that a ring-shaped seal member 28 is inserted into one of two adjoining cylinder blocks 27 at an outer circumferential edge portion of the fitting face. The seal member 28 is a seal member for static use with low pressure.

Furthermore in the present embodiment, among the plurality of cylinder blocks 27, the cylinder blocks 27 installed at positions other than both ends in the axial direction of the cylinder 12 and the cylinder blocks 27 installed at both ends have different fitting face configurations. In the cylinder blocks 27 installed at positions other than both ends in the axial direction of the cylinder 12, both end faces in the axial direction of the cylinder 12 are provided as fitting faces that are brought into close contact with the cylinder block 27 to be fitted together, and define the piston chamber 24. On the other hand, in the cylinder blocks 27 installed at both ends in the axial direction of the cylinder 12, one end face is provided as a fitting face that is brought into close contact with the cylinder block 27 to be fitted together, and defines the piston chamber 24. The other end face of those cylinder blocks 27 are provided as a fitting face to be brought into close contact with the lid portion (22*a*, 22*b*).

Note that when forming the abovementioned grooves each having a semicircular cross section that make holes each with a circular cross section to form the piston chambers 24 as a result of the cylinder blocks 27 being put together, firstly machining of the material of the cylinder blocks 27 is performed to make the grooves extending in an arc in the circumferential direction of the cylinder 12, for example. After the machining, polishing is performed on the machined wall surfaces that constitute the semicircular cross sections, thereby forming the grooves extending in an arc in the circumferential direction of the cylinder 12 having a smooth arc cross section.

The output shaft 13 is supported rotatably with respect to the case 11 and installed in the hollow space 23, with the axial direction thereof being parallel to the axial direction of the cylinder 12. The output shaft 13 is provided with a shaft portion 13*a* and end portions (13*b*, 13*c*).

The shaft portion 13*a* is provided as a columnar portion whose axial direction coincides with the axial direction of the cylinder 12. The end portions 13*b* and 13*c* are integrated respectively with the ends of the shaft portion 13*a*. The end portion 13*b* is supported so as to be able to slide and rotate with respect to the lid portion 22*a* of the case 11. The end portion 13*c* is supported so as to be able to slide and rotate with respect to the lid portion 22*b* of the case 11.

Between the outer circumference of the end portion 13*b* and the inner circumference of the through hole of the lid portion 22*a*, ring-shaped seal members 29 are installed. In the present embodiment, the seal members 29 are inserted into seal grooves formed on the inner circumference of the lid portion 22*a*, and the end portion 13*b* is inserted inward of the seal members 29. Note that in the present embodiment, the plurality of seal members 29 are installed. Meanwhile, between the outer circumference of the end portion 13*c* and the inner circumference of the through hole of the lid portion 22*b*, ring-shaped seal members 30 are installed. In the present embodiment, the seal members 30 are inserted into seal grooves formed on the inner circumference of the lid portion 22*b*, and the end portion 13*c* is inserted inward of the seal member 30. Note that in the present embodiment, the plurality of seal members 30 are installed.

The output shaft 13 and the case 11 are sealed against each other by those seal members (29, 30). Each seal member (29, 30) is formed in a ring shape, and the outer circumference of the output shaft 13 slides in the circumferential direction along the inner circumference of the seal member (29, 30). Therefore, those seal members (29, 30) are configured as the seal members whose specifications are similar to those of the seal members used in the linear sliding portion. Note that those seal members (29, 30) do not necessarily have to be provided. Even in this case, the outer circumference of the output shaft 13 and the inner circumference of the lid portions (22*a*, 22*b*) of the case 11 are sufficiently sealed against each other.

Furthermore, the seal grooves into which the seal members (29, 30) are inserted do not necessarily have to be provided in the lid portions (22*a*, 22*b*). The seal grooves into which the seal members (29, 30) are inserted may be provided only in the end portions (13*b*, 13*c*), or may alternatively be provided in both the lid portions (22*a*, 22*b*) and the end portions (13*b*, 13*c*).

Each arm unit 15 has a plurality of arms (15*a*, 15*b*). In the present embodiment, the arm unit 15 has a pair of (two) arms (15*a*, 15*b*). Each arm (15*a*, 15*b*) is integrated with the output shaft 13, and provided so as to extend in the radial direction of the cylinder 12. Furthermore, in the present embodiment, a plurality of arm units 15 are provided and arranged in line along the axial direction of the output shaft 13. Therefore, the plurality of arms (15*a*, 15*b*) are provided so as to extend in the radial direction of the cylinder 12 from a plurality of positions on the output shaft 13. In the present embodiment, the arms (15*a*, 15*b*) are provided so as to extend in the radial direction of the cylinder 12 from a plurality of positions in the axial direction of the output shaft 13, as well as a plurality of positions in the circumferential direction of the output shaft 13. The arms (15*a*, 15*b*) are installed with the output shaft 13 in the hollow space 23. Note that the arms (15*a*, 15*b*) may be provided as separate members from the output shaft 13 and fixed thereto.

Furthermore, in the present embodiment, each arm (15*a*, 15*b*) has two plate-like portions whose outer form substantially is a trapezoid having corner portions each formed into an arc shape. One end side of each arm (15*a*, 15*b*) is integrated with the output shaft 13 so as to be held thereby in a cantilevered manner. The two plate-like portions of each arm (15*a*, 15*b*) are provided along a direction perpendicular to the axial direction of the output shaft 13 so as to extend parallel to each other.

The arms 15*a* and 15*b* in each arm unit 15 are provided so as to extend in the radial direction of the cylinder 12 from the same position in the axial direction of the output shaft 13. Furthermore, the arms 15*a* and 15*b* in each arm unit 15 are provided so that the angle formed by the arms 15*a* and 15*b* in the circumferential direction of the cylinder 12 is 180 degrees, that is, so as to extend from the output shaft 13 along the diameter direction of the cylinder 12 in the radial direction of the cylinder 12. With this configuration, in the present embodiment, the configuration in which the plurality of arms (15*a*, 15*b*) are provided so as to extend in the radial direction of the cylinder 12 along the same plane perpendicular to the axial direction of the output shaft 13 is implemented.

Figure 5:
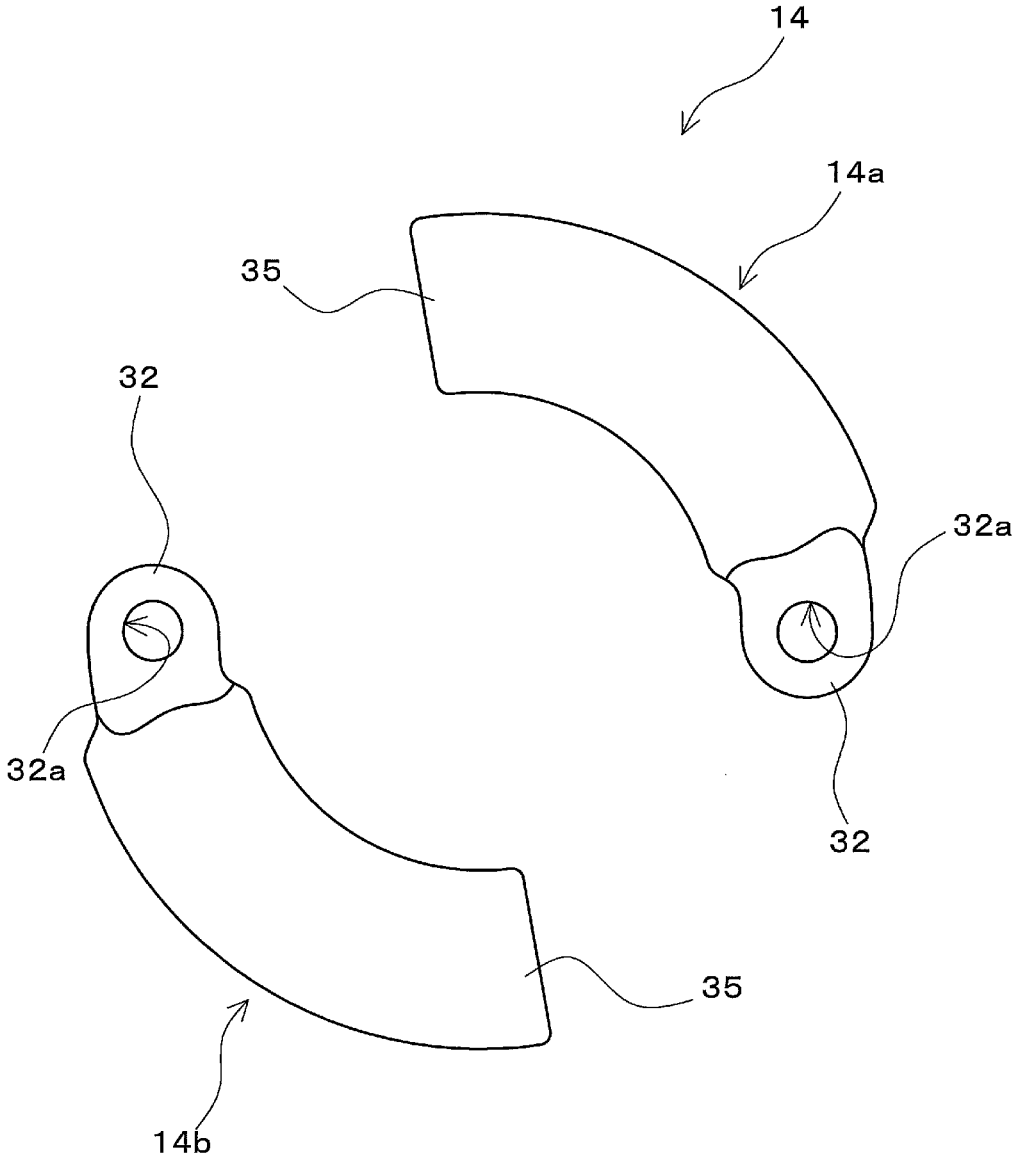
FIG. 5 is a diagram showing a piston unit in the rotary actuator shown in FIG. 2.

FIG. 5 is a diagram showing a piston unit 14. The rotary actuator 1 is provided with the plurality of piston units 14 shown in FIGS. 1 to 5, and each piston unit 14 is configured as a pair of arc pistons (14*a*, 14*b*). The plurality of piston units 14 are arranged in line in the axial direction of the output shaft 13. Each arc piston (14*a*, 14*b*) constitutes a piston in the present embodiment. Further, each arc piston (14*a*, 14*b*) is formed in an arc shape, and is provided with a portion having a circular cross section and extending in an arc. Note that with the above-described configuration, in the present embodiment the plurality of arc pistons (14*a*, 14*b*) are provided and arranged in line in the axial direction of the output shaft 13.

The arc pistons (14*a*, 14*b*) are installed in the piston chambers 24 within the cylinder 12 and supported so as to be able to slide and be displaced with respect to the cylinder 12 along the circumferential direction of the cylinder 12. The pairs of arc pistons (14*a*, 14*b*) are installed in the piston chambers 24 (24*a*, 24*b*) defined between adjoining cylinder blocks 27. Note that the arc pistons 14*a* are installed in the piston chambers 24*a*, and the arc pistons 14*b* are installed in the piston chambers 24*b*.

Furthermore, the arc pistons (14*a*, 14*b*) are installed slidably with respect to the wall surfaces of the piston chambers (24*a*, 24*b*) along the direction in which the piston chambers (24*a*, 24*b*) extend in an arc. That is, the arc pistons 14*a* are slidably installed in the piston chambers 24*a*, and the arc pistons 14*b* are slidably installed in the piston chambers 24*b*. Note that in the cylinder 12, the piston chambers 24 (24*a*, 24*b*) are provided as space for housing the arc pistons (14*a*, 14*b*) supported so as to be able to slide and be displaced with respect to the cylinder 12.

As described above, each piston unit 14 is constituted by the plurality of arc pistons (14*a*, 14*b*) installed along the same plane perpendicular to the axial direction of the output shaft 13 so as to extend in the circumferential direction of the cylinder 12. Note that the plurality of arc pistons (14*a*, 14*b*) in each piston unit 14 and the plurality of arms (15*a*, 15*b*) in each arm unit 15 are installed so as to extend along the same plane perpendicular to the axial direction of the output shaft 13.

The wall surface of each piston chamber (24*a*, 24*b*) is provided with a seal groove, and a ring-shaped seal member 34 is inserted into this seal groove. For example, one seal member 34 is installed for each arc piston (14*a*, 14*b*) in each piston chamber (24*a*, 24*b*). The arc pistons (14*a*, 14*b*) are slidably inserted into the respective seal members 34. Thus the liquid tightness or air tightness between the wall surface of the piston chambers (24*a*, 24*b*) and the outer circumference of the arc pistons (14*a*, 14*b*) is further improved. Those seal members 34 are configured as the seal members whose specifications are similar to those of the seal members used in the linear sliding portion. Note that these seal members 34 do not necessarily have to be provided. Even in this case, the wall surface of the piston chambers (24*a*, 24*b*) and the outer circumference of the arc pistons (14*a*, 14*b*) are sufficiently sealed against each other. Alternatively, a configuration in which the seal members 34 are inserted into not the piston chambers (24*a*, 24*b*) but the arc pistons (14*a*, 14*b*) may be implemented.

Note that when manufacturing the arc pistons (14*a*, 14*b*), first, for example, two portions of a circular ring member in its circumferential direction are cut off by machining. The two portions that are thus cut off are set to be, for example, two portions opposite to each other via the center of the ring member in the radial direction, that is, two portions of the circular ring member that are diametrically opposed. Thus the material of the pair of arc pistons (14*a*, 14*b*) is cut out of the circular ring member. Next, polishing is performed on the outer circumference of the material of the pair of arc pistons (14*a*, 14*b*), thereby forming the outer circumferential side surface of the arc pistons (14*a*, 14*b*) that form a circumferential cross section and slide with respect to the piston chambers 24 (24*a*, 24*b*).

The arc pistons (14*a*, 14*b*) in each piston unit 14 are rotatably connected at their end portions 32 respectively to the arms (15*a*, 15*b*) in the corresponding arm unit 15 via rotary shafts 33. In other words, one end portion 32 of the arc piston 14*a* is rotatably connected to the arm 15*a* via the rotary shaft 33. One end portion 32 of the arc piston 14*b* is rotatably connected to the arm 15*b* via the rotary shaft 33.

The end portion 32 of each arc piston (14*a*, 14*b*) is provided as a plate-like portion thinly extending from the portion having a circular cross section and extending in an arc. This end portion 32 has a through hole 32*a* through which the rotary shaft 33 passes in a rotatable state around its shaft center. The end portions 32 of the arc pistons (14*a*, 14*b*) are installed so as to project from openings of the piston chambers (24*a*, 24*b*) to the hollow space 23.

Furthermore, the end portion 32 of each arc piston (14*a*, 14*b*) is installed between the two plate-like portions of the arm (15*a*, 15*b*) with a small gap between the end portion 32 and each plate-like portion. Each plate-like portion of the arm (15*a*, 15*b*) has a through hole. The end portion 32 of each arc piston (14*a*, 14*b*) is installed with respect to the arm (15*a*, 15*b*) in a positional relationship in which both through holes in the pair of plate-like portions communicate with the through hole 32*a* of the end portion 32. Note that the end portion 32 of each arc piston 14*a* is installed between the two plate-like portions of the arm 15*a*, and the end portion 32 of each arc piston 14*b* is installed between the two plate-like portions of the arm 15*b*.

In the present embodiment, each rotary shaft 33 is configured as a bolt member having a pin-like shaft portion having a columnar shape provided with an external thread portion at its tip. Each rotary shaft 33 is installed so as to pass through the two plate-like portions of the arm (15*a*, 15*b*) and the end portion 32 of the arc piston (14*a*, 14*b*) installed therebetween. At this time, the rotary shaft 33 engages at its bolt head with one of the two plate-like portions of the arm (15*a*, 15*b*) from the outside, and the external thread portion on the tip side projects from the other plate-like portion. Furthermore, each rotary shaft 33 is mounted so that a nut member provided with an inner circumferential internal thread portion is screwed with the external thread portion at the tip of the rotary shaft 33. Note that a detent is provided to the nut member and the tip of each rotary shaft 33 to prevent the nut member from falling away from the rotary shaft 33.

As described above, the end portion 32 of each arc piston (14*a*, 14*b*) is installed rotatably with respect to the arm (15*a*, 15*b*) via the rotary shaft 33 between the two plate-like portions of the arm (15*a*, 15*b*). In other words, the arc pistons (14*a*, 14*b*) in the piston unit 14 are connected rotatably with respect to the arms (15*a*, 15*b*) in the respective arm units 15. Furthermore, the pairs of arc pistons (14*a*, 14*b*) in the piston units 14 are provided so as to be able to bias the respective pairs of arms (15*a*, 15*b*) in the arm units 15 in the same rotational direction along the circumferential direction of the cylinder 12.

Here, the configuration of pressure chambers (25, 26*a*, 26*b*) for operating the arc pistons (14*a*, 14*b*) by means of feed and discharge of the pressure oil will be described. The cylinder 12 is internally provided with a pressure chamber 25, which serves as a first pressure chamber in the present embodiment, and pressure chambers (26*a*, 26*b*), which serve as second pressure chambers in the present embodiment.

The pressure chamber 25 is provided as a region into which the pressure oil serving as the pressure medium is introduced. The pressure chamber 25 is formed by the hollow space 23, and houses the output shaft 13 and the plurality of arm units 15. To the pressure chamber 25, a plurality of feed/discharge holes 31 through which the pressure oil is fed and discharged are open. The feed/discharge holes 31 are provided as, for example, holes that communicate with the pressure chamber 25 in the lid portion 22*b* of the case 11. When the pressure oil is fed into the pressure chamber 25, the pressure oil is fed from the plurality of feed/discharge holes 31 with substantially the same timing. When the pressure oil is discharged from the pressure chamber 25, the pressure oil is discharged from the plurality of feed/discharge holes 31 with substantially the same timing.

The pressure chambers (26*a*, 26*b*) are configured as regions defined respectively in the piston chambers (24*a*, 24*b*) in which the arc pistons (14*a*, 14*b*) are slidably supported. Each pressure chamber (26*a*, 26*b*) is defined as a region into which the pressure oil serving as the pressure medium is introduced between the arc piston (14*a*, 14*b*) in the piston chamber (24*a*, 24*b*) and the cylinder 12. Furthermore, in each pressure chamber (26*a*, 26*b*), another end portion 35 of the arc piston (14*a*, 14*b*) that is located opposite from the end portion 32 connected to the arm (15*a*, 15*b*) is slidably installed. Note that the pressure chamber 26*a* is defined by the wall surface of the piston chamber 24*a* and an end surface of the other end portion 35 of the arc piston 14*a*. The pressure chamber 26*b* is defined by the wall surface of the piston chamber 24*b* and an end surface of the other end portion 35 of the arc piston 14*b*.

To each pressure chamber 26*a*, a feed/discharge hole 30*a* through which the pressure oil is fed and discharged is open. To the pressure chamber 26*b* as well, a feed/discharge hole 30*b* through which the pressure oil is fed and discharged is open. The feed/discharge holes 30*a* are provided so as to pass through the cylinder 12 in its axial direction through the cylinder blocks 27. The feed/discharge holes 30*a* in the respective cylinder blocks 27 are arranged in tandem throughout the cylinder blocks 27 so as to communicate with one another. The feed/discharge holes 30*b* are also provided so as to pass through the cylinder 12 in its axial direction through the cylinder blocks 27. The feed/discharge holes 30*b* in the respective cylinder blocks 27 are arranged in tandem throughout the cylinder blocks 27 so as to communicate with one another. Note that the feed/discharge holes 30*a* may be branched from a common oil feed/discharge path to the respective pressure chambers 26*a* so as to communicate therewith. The feed/discharge holes 30*b* may also be branched from a common oil feed/discharge path to the respective pressure chambers 26*b* so as to communicate therewith.

The pressure oil is fed and discharged into/from the pressure chambers 26*a* and 26*b* with substantially the same timing. When the pressure oil is fed into the pressure chambers 26*a* and 26*b*, the pressure oil is fed from the feed/discharge holes 30*a* and 30*b* with substantially the same timing. When the pressure oil is discharged from the pressure chambers 26*a* and 26*b*, the pressure oil is discharged from the feed/discharge holes 30*a* and 30*b* with substantially the same timing.

In the rotary actuator 1, the pressure oil is supplied to one of the pressure chamber 25 serving as the first pressure chamber and the pressure chambers (26*a*, 26*b*) serving as the second pressure chambers, and is discharged from the other pressure chamber. Each pair of arc pistons (14*a*, 14*b*) are thereby displaced. Thus each pair of arms (15*a*, 15*b*) biased by the pair of arc pistons (14*a*, 14*b*) is displaced in the circumferential direction of the cylinder 12. Then the output shaft 13 pivots with the arms (15, 15*b*) in a rotational direction around its shaft center.

In the rotary actuator 1, the feed/discharge holes 30*a* in the cylinder blocks 27 communicate with one another, and therefore the pressure oil is fed with substantially the same timing into, and discharged with substantially the same timing from, the plurality of pressure chambers 26*a*. Similarly, the feed/discharge holes 30*b* in the cylinder blocks 27 communicate with one another, and therefore the pressure oil is fed with substantially the same timing into, and discharged with substantially the same timing from, the plurality of pressure chambers 26*b*. As described above, the pressure oil is fed and discharged with substantially the same timing from the feed/discharge holes 30*a* and 30*b*.

For example, when the pressure oil is fed from the feed/discharge holes (30*a*, 30*b*) and discharged from the feed/discharge holes 31, the arc pistons 14*a* and 14*b* are displaced clockwise along the circumferential direction of the cylinder 12 in FIG. 2. Thus the arms (15*a*, 15*b*) and the output shaft 13 pivot clockwise along the circumferential direction of the cylinder 12 in FIG. 2. On the other hand, when the pressure oil is fed from the feed/discharge holes 31 and discharged from the feed/discharge holes (30*a*, 30*b*), the arc pistons 14*a* and 14*b* are displaced anticlockwise along the circumferential direction of the cylinder 12 in FIG. 2. Thus the arms (15*a*, 15*b*) and the output shaft 13 pivot anticlockwise along the circumferential direction of the cylinder 12 in FIG. 2.

Note that the assembly operation of the above-described rotary actuator 1 can be implemented in various orders. Next, an exemplary assembly procedure of the rotary actuator 1 will be discussed. First, for example, an integrated molding of the output shaft 13 and the plurality of arm units 15 is attached to the lid portion 22*b* in a state where the lid portion 22*b* is held by a jig. Then, the cylinder blocks 27 are sequentially put together in tandem in the axial direction of the cylinder 12 in a state where the output shaft 13 and the arm units 15 are inserted in the hollow space 23.

When the cylinder blocks 27 are sequentially put together, the arc pistons (14*a*, 14*b*) each having the seal member 34 attached thereto are installed in the respective piston chambers (24*a*, 24*b*) between the cylinder blocks 27. At this time, the arc pistons (14*a*, 14*b*) are rotatably connected to the respective arms (15*a*, 15*b*) via the rotary shafts 33. At the stage where assembly by putting together the cylinder blocks 27 is finished, the case main body portion 21 is placed on the outer circumference of the cylinder 12 so that the cylinder 12 is inserted into the case main body portion 21. After finishing placing the case main body portion 21, the lid portion 22*a* is attached and fixed to the case main body portion 21. The outline of the assembly operation of the rotary actuator 1 is thus completed.

Figure 6:
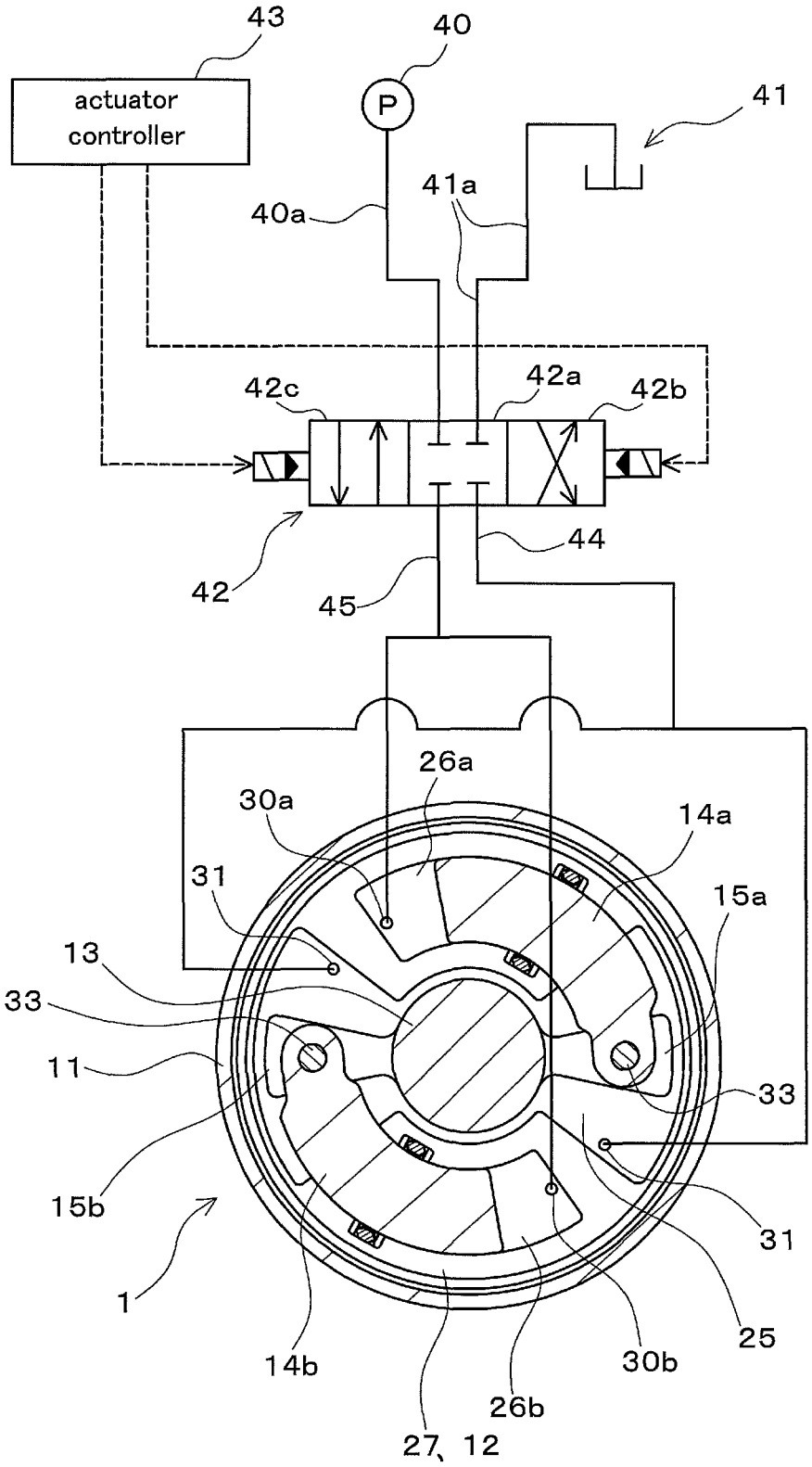
FIG. 6 is a circuit diagram schematically showing a hydraulic circuit for controlling operation of the rotary actuator shown in FIG. 2.

Next, the configuration of a hydraulic circuit for controlling the operation of the above-described rotary actuator 1 and actuation of the rotary actuator 1 will be discussed. FIG. 6 is a circuit diagram schematically showing the hydraulic circuit for controlling the operation of the rotary actuator 1, together with the cross-sectional view of the rotary actuator 1 shown in FIG. 2. As shown in FIG. 6, the pressure oil serving as the pressure medium is fed into the rotary actuator 1 from a hydraulic power source 40, which is a pressure medium supply source in the present embodiment. The hydraulic power source 40 has a hydraulic pump. The pressure oil discharged from the rotary actuator 1 then flows into, and thus returns to, a reservoir circuit 41. The pressure oil, after returning to the reservoir circuit 41, is pressurized by the hydraulic power source 40, and is fed again to the rotary actuator 1.

Between the rotary actuator 1 and the hydraulic power source 40 and reservoir circuit 41, a control valve 42 for switching a pressure oil feeding path to the rotary actuator 1 and a pressure oil discharge path from the rotary actuator 1 is provided. That is, the rotary actuator 1 is connected to the hydraulic power source 40 and the reservoir circuit 41 via the control valve 42.

The control valve 42 is provided as a valve mechanism for switching the state of connection between a pair of feed/discharge paths (44, 45) that communicate with the rotary actuator 1 and the feed path 40*a* communicating with the hydraulic power source 40 and the discharge path 41*a* communicating with the reservoir circuit 41. The feed/discharge path 44 communicates with the feed/discharge holes 31 in the case 11, and the feed/discharge path 45 communicates with the feed/discharge holes (30*a*, 30*b*) in the cylinder blocks 27.

Furthermore, the control valve 42 is provided as, for example, an electrohydraulic servo valve (EHSV). The control valve 42 operates to switch the state of connection between the feed/discharge paths (44, 45) and the feed path 40*a* and discharge path 41*a* based on an instruction signal from an actuator controller 43 that controls the operation of the rotary actuator 1. More specifically, in the control valve 42, a nozzle-flapper hydraulic pressure amplification mechanism at the pilot stage is driven based on an electric instruction signal from the actuator controller 43, and the pressure of the pilot pressure oil introduced into both ends of the spool at the main stage is controlled. With the pilot pressure oil produced at the pilot stage, the position of the spool at the main stage is proportionally controlled, and the above-mentioned state of connection between the paths 40*a* and 41*a* and the paths 44 and 45 is switched.

With the above-described configuration, the control valve 42 is able to proportionally switch its position among a neutral valve position 42*a*, a first switching position 42*b*, and a second switching position 42*c*. In a state of being switched to the neutral valve position 42*a*, the control valve 42 disconnects the feed path 40*a* and the discharge path 41*a* from the feed/discharge paths (44, 45). Thus feed and discharge of the pressure oil to/from the pressure chamber 25 and the pressure chambers (26*a*, 26*b*) are stopped. Then the state where the arc pistons (14*a*, 14*b*) installed in the piston chambers (24*a*, 24*b*) are stopped is kept.

Upon the control valve 42 being switched from the neutral valve position 42*a* to the first switching position 42*b*, the feed path 40*a* is connected to the feed/discharge path 44 and the pressure oil is fed into the pressure chamber 25. Meanwhile, the discharge path 41*a* is connected to the feed/discharge path 45 and the pressure oil is discharged from the pressure chambers (26*a*, 26*b*). Thus the arc pistons (14*a*, 14*b*) are displaced anticlockwise along the circumferential direction of the cylinder 12 in FIG. 5. On the other hand, upon the control valve 42 being switched from the neutral valve position 42*a* to the second switching position 42*c*, the feed path 40*a* is connected to the feed/discharge path 45 and the pressure oil is fed into the pressure chambers (26*a*, 26*b*). Meanwhile, the discharge path 41*a* is connected to the feed/discharge path 44 and the pressure oil is discharged from the pressure chamber 25. Thus the arc pistons (14*a*, 14*b*) are displaced clockwise along the circumferential direction of the cylinder 12 in FIG. 5. As described above, when the control valve 42 is switched to the first switching position 42*b* and when it is switched to the second switching position 42*c*, the arc piston (14*a*, 14*b*) installed in each piston chamber (24*a*, 24*b*) moves in opposite directions along the circumferential direction of the cylinder 12, and the arms 15 and the output shaft 13 are driven to pivot in opposite directions.

As a result of the output shaft 13 pivoting, driving torque is output from the output shaft 13. The driving torque may be output only from one of the end portions 13*b* and 13*c* of the output shaft 13, or may be output from both the end portions (13*b*, 13*c*) of the output shaft 13. Note that the driving torque output from the output shaft 13 is output for an object to be driven that is connected to at least one of the end portions (13*b*, 13*c*). The object to be driven may be various kinds of equipment. For example, a moving surface such as a control surface pivotably provided on a wing of an aircraft may be driven by the rotary actuator 1. Furthermore, the rotary actuator 1 may be applied to steering equipment for cars and the like.

Note that in the above-described embodiment, the control valve 42 and the actuator controller 43 are not described as components of the rotary actuator 1, but those may alternatively be included in the components of the rotary actuator 1. For example, the rotary actuator 1 may be defined as having a configuration including the control valve 42 as a component thereof. Alternatively, the rotary actuator 1 may be defined as having a configuration including the control valve 42 and the actuator controller 43 as components thereof.

As discussed above, with the rotary actuator 1, the pressure oil (pressure medium) is fed into one of the first pressure chamber 25 and the second pressure chambers (26*a*, 26*b*) and is discharged from the other inside the cylinder 12 installed within the case 11, and the arc pistons (14*a*, 14*b*) thereby slide and are displaced in the circumferential direction of the cylinder 12. The arms (15*a*, 15*b*), to which the respective arc pistons (14*a*, 14*b*) are rotatably connected, are driven by the arc pistons (14*a*, 14*b*), and the output shaft 13 thereby pivots with the arms (15*a*, 15*b*) in the rotational direction. Thus the driving torque of the rotary actuator 1 is output.

As described above, with the rotary actuator 1, the first pressure chamber 25 on one end portion 32 side of each arc piston (14*a*, 14*b*) that slides with respect to the cylinder 12 and the second pressure chambers (26*a*, 26*b*) on the other end portion 35 side are defined within the cylinder 12. Thus, such a structure provided with pressure chambers defined by an output shaft, vanes, a cylinder, ribs, and end caps, as the structure of the conventional rotary actuators, is not necessary. That is, the rotary actuator 1 does not need rotary sliding portions between an output shaft and ribs provided to a cylinder, between the cylinder and vanes provided to the rotary output shaft, and between the rotary output shaft with the vanes and end caps. As a result, with the rotary actuator 1, internal leakage of the pressure oil (pressure medium) within the rotary actuator 1 can be reduced. In addition, the rotary actuator 1 does not need, or is able to greatly reduce the number of, high-pressure rotary seals that are used in the rotary sliding portions and pressed with high pressure against the surface relative to which the seals slide.

Consequently, according to the present embodiment, it is possible to provide the rotary actuator 1 capable of reducing internal leakage of pressure medium, and whose structure does not need the high-pressure rotary seals or is able to significantly reduce the number of the high-pressure rotary seals.

Furthermore, in the rotary actuator 1, the arc pistons (14*a*, 14*b*) that drive, via the arms (15*a*, 15*b*), the output shaft 13 to rotate are rotatably connected to the arms (15*a*, 15*b*). Therefore, even if an external load acts on the output shaft 13, the arms (15*a*, 15*b*) can be prevented from separating from the arc pistons (14*a*, 14*b*). Consequently, in the case where a servo control mechanism is built for control of the rotational position of the output shaft 13 driven by the arc pistons (14*a*, 14*b*) that are displaced due to feed and discharge of the pressure oil to/from the first pressure chamber 25 and second pressure chambers (26*a*, 26*b*), reduction in the responsiveness of this servo mechanism can be suppressed. That is, even if the responsiveness of the above servo mechanism is increased, momentary incapability of the above-mentioned rotational position control is prevented.

Furthermore, in the rotary actuator 1, the cylinder 12 is assembled by putting together the plurality of cylinder blocks 27 in the axial direction of the cylinder 12, and the piston chambers 24 (24*a*, 24*b*) are defined between the adjoining cylinder blocks 27. Therefore, when the piston chambers 24 (24*a*, 24*b*) are formed, a semicircular groove is formed on each cylinder block 27, and these grooves are combined to constitute the piston chambers 24 (24*a*, 24*b*). It is thus possible to easily form the piston chambers 24 (24*a*, 24*b*) for housing the arc pistons (14*a*, 14*b*) that slide and are displaced in the circumferential direction of the cylinder 12, and to easily manufacture the cylinder 12.

Moreover, in the rotary actuator 1, the output shaft 13 is driven via the arms (15*a*, 15*b*) by the piston units 14 arranged in line along the axial direction of the output shaft 13. Therefore, it is possible to output a larger amount of driving torque with a compact structure, without increasing the size of the cylinder 12 in its radial direction.

Furthermore, in the rotary actuator 1, the output shaft 13 can be driven to rotate by the arc pistons (14*a*, 14*b*) in the piston units 14 each installed along the same plane perpendicular to the axial direction of the output shaft 13. Therefore, it is possible to output a lager amount of driving torque while preventing the rotary actuator 1 from becoming longer in the axial direction of the cylinder 12, and also preventing the rotary actuator 1 from becoming larger in the radial direction of the cylinder 12. In the case where each piston unit 14 is constituted by two arc pistons (14*a*, 14*b*) as in the present embodiment, it is possible to double the output of the rotary actuator 1 without increasing its length in the axial direction and in the size in the radial direction.

Although an embodiment of the present invention has been described thus far, the present invention is not limited to the embodiment described above, and various modifications may be made within the scope recited in the claims. For example, the present invention modified as below may be implemented.

(1) Although the above embodiment has been described, taking, as an example, a mode in which the cylinder is integrally assembled by putting together the cylinder blocks, this need not be the case. For example, the cylinder may be manufactured in a mode in which a block-shaped member used as the material of the cylinder is punched by electromechanical machining to form the piston chambers.

Figure 7:
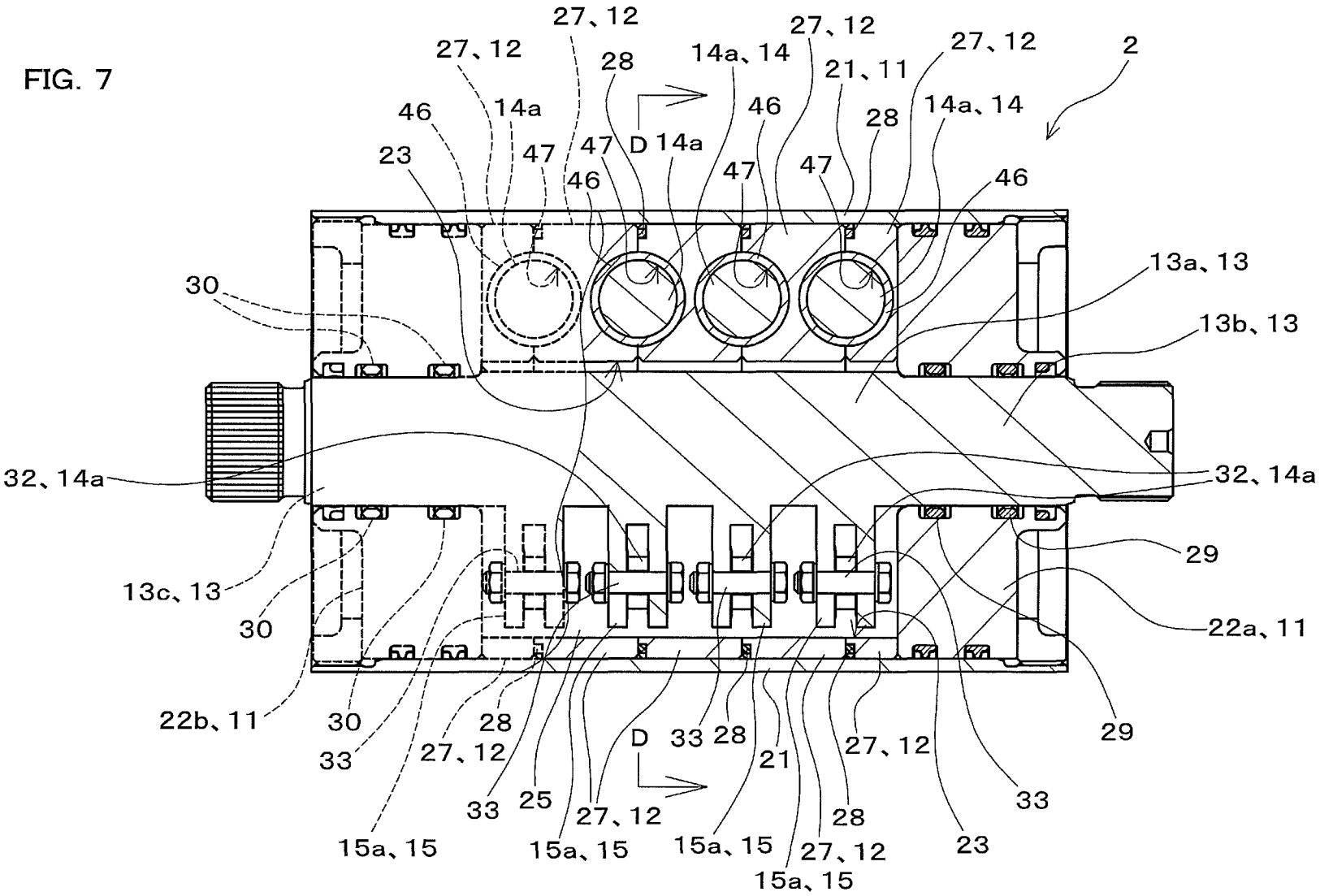
FIG. 7 is a diagram showing a rotary actuator according to a modification including a partial cross-sectional view thereof, viewed from a direction perpendicular to an axial direction thereof.
Figure 8:
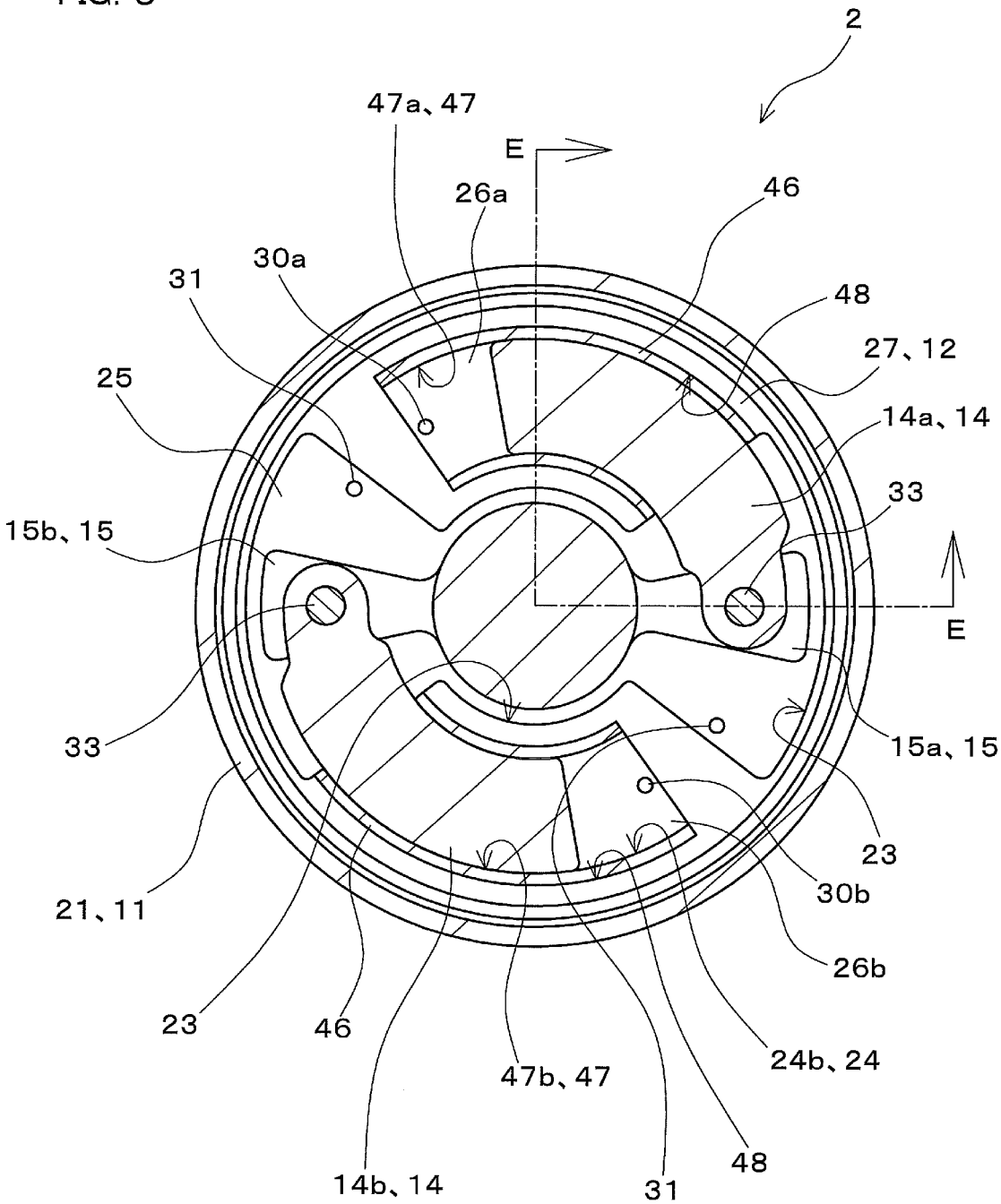
FIG. 8 is a diagram showing the rotary actuator shown in FIG. 7 including a cross-sectional view thereof, viewed along arrows D-D.

(2) Although the above embodiment has been described, taking, as an example, a mode in which the piston chambers are defined between the adjoining cylinder blocks by putting together the grooves with a semicircular cross section that are formed on the respective cylinder blocks, this need not be the case. As shown in FIGS. 7 and 8, a mode in which the piston chambers are defined by tubular hollow members that are installed in holes provided in the cylinder main body and extend in an arc may alternatively be implemented.

FIG. 7 is a diagram showing a rotary actuator 2 according to a modification of the present invention including a partial cross-sectional view thereof, viewed from a direction perpendicular to the axial direction. FIG. 8 is a cross-sectional view of the rotary actuator 2, viewed along arrows D-D in FIG. 7. FIG. 8 includes the cross-section viewed along arrows E-E in FIG. 7. The rotary actuator 2 shown in FIGS. 7 and 8 is different from the rotary actuator 1 with regard to the structure for defining piston chambers 47 (47*a*, 47*b*). Note that in the following description of the rotary actuator 2, the components configured in the same manner as those of the rotary actuator 1 are denoted by the same reference numerals in the figures, and the description thereof will be omitted. Only the features different from those of the rotary actuator 1 will be described.

In the rotary actuator 2, the plurality of cylinder blocks 27 that are put together and integrated with one another constitute the main body of the cylinder 12. The cylinder 12 in the rotary actuator 2 is further provided with tubular hollow members 46 extending in an arc.

A plurality of the hollow members 46 are provided. The hollow members 46 are separately installed in holes (48) formed by combining the adjoining cylinder blocks 27 with one another in the main body of the cylinder 12. That is, two hollow members 46 are installed between each two adjoining cylinder block 27. Piston chambers (47*a*, 47*b*) for housing the respective arc pistons (14*a*, 14*b*) supported so as to be able to slide and be displaced with respect to the cylinder 12 are defined by the inner wall of the hollow members 46. Note that when molding the hollow members 46, a tubular hollow member, for example, is used as a material thereof. After, for example, this material is bent in an arc, the material is further subjected to press work using isostatic molding, and thus the tubular hollow members 46 that smoothly extending in an arc are molded.

In the rotary actuator 2 according to the above-described modification, the members for defining the piston chambers 47 (47*a*, 47*b*) are constituted by the tubular hollow members 46 provided as separate members from the main body of the cylinder 12. It is therefore possible to easily form the piston chambers 47 (47*a*, 47*b*) having a structure in which the surface relative to which the arc pistons (14*a*, 14*b*) slide is seamless, and further, internal leakage can be reduced.

(3) The shape of the arm, the number of the installed arms, and the installation position are not limited to those in the mode taken as an example in the above embodiment, and may be modified in various ways for implementation. For example, in the above-described embodiment, a mode in which two arms are provided that extend in the radial direction of the cylinder along the same plane perpendicular to the axial direction of the output shaft has been taken as an example. However, this need not be the case. For example, a mode provided with a single arm or three or more arms extending in the radial direction of the cylinder along the same plane perpendicular to the axial direction of the output shaft may alternatively be implemented.

Furthermore, although the above embodiment has been described, taking, as an example, a mode in which the plurality of arms are arranged in line along the axial direction of the output shaft and extend parallel to each other, this need not be the case. For example, a configuration in which a single plate-like arm extending along the axial direction of the output shaft is provided, and the plurality of pistons are rotatably connected to this plate-like arm may alternatively be implemented. In this case, a plurality of slit-like spaces may be formed in the plate-like arm, and the ends of the pistons may be rotatably connected to the respective spaces. Furthermore, in this case, the plurality of pitons may be rotatably connected to the arm by the same columnar pin members extending parallel to the axial direction of the output shaft.

Note that the mode of the arms extending in the radial direction of the cylinder from the plurality of positions on the output shaft is not limited to the mode described as an example in the above-described embodiment, and may be modified in various ways for implementation. In the case where the arms are provided so as to extend radially from the plurality of positions on the output shaft, and thus the plurality of pistons for driving, via the arms, the output shaft to rotate are installed, the design associated with the installation position thereof can be made more freely.

The present invention can be applied widely to rotary actuators that output driving torque as a result of output shafts thereof pivoting in a rotational direction due to action of a pressure medium. The present invention is not limited to the above-described embodiment, and all modifications, applications and equivalents thereof that fall within the claims, for which modifications and applications would become apparent by reading and understanding the present specification, are intended to be embraced therein.

What is claimed is:

1. A rotary actuator that outputs driving torque as a result of an output shaft pivoting in a rotational direction due to action of a pressure medium, the rotary actuator comprising:

a case;

a cylinder that is installed within the case and internally has a hollow space, the cylinder being prevented from rotating relative to the case in both circumferential directions of the case;

an output shaft that is rotatably supported with respect to the case, has an axial direction parallel to an axial direction of the cylinder, and is installed in the hollow space;

an arm that is integrated with, or fixed to, the output shaft, and extends in a radial direction of the cylinder; and a piston that has a portion extending in an arc, and is installed within the cylinder and supported so as to be able to slide and be displaced with respect to the cylinder along a circumferential direction of the cylinder, wherein one end portion of the piston is connected to the arm so as to be rotatable about an axis with respect to the arm, the axis being parallel with the axial direction of the output shaft and being shifted from the output shaft in the radial direction of the cylinder, the cylinder is internally provided with a first pressure chamber in which the output shaft and the arm are housed, and a second pressure chamber that is defined by the cylinder and the piston and in which another end portion of the piston that is located opposite from the end portion thereof connected to the arm is slidably installed, and as a result of a pressure medium being fed into one of the first pressure chamber and the second pressure chamber and discharged from the other, the arm is displaced in the circumferential direction of the cylinder, and the output shaft pivots in the rotational direction.

2. The rotary actuator according to claim 1, wherein the cylinder includes a plurality of cylinder blocks each formed in a divided state, the cylinder is integrally assembled by putting together the plurality of cylinder blocks along the axial direction of the cylinder, the cylinder is provided with a piston chamber that houses the piston supported so as to be able to slide and be displaced with respect to the cylinder, and the piston chamber is defined between the cylinder blocks adjoining in the axial direction of the cylinder.

3. The rotary actuator according to claim 1, wherein a plurality of the pistons are provided, and the plurality of pistons are arranged in line along an axial direction of the output shaft.

4. The rotary actuator according to claim 1, wherein a plurality of the arms are provided so as to extend in the radial direction of the cylinder from a plurality of positions on the output shaft.

5. The rotary actuator according to claim 1, wherein a plurality of the arms are provided so as to extend in radial directions of the cylinder from a plurality of positions in a circumferential direction of the output shaft on the output shaft, the plurality of arms are provided to extend in the radial directions of the cylinder along the same plane perpendicular to the axial direction of the output shaft, at least one piston unit constituted by the plurality of pistons installed so as to extend in the circumferential direction of the cylinder along the same plane is provided, and the pistons in the piston unit are rotatably connected to the respective arms.

6. The rotary actuator according to claim 5, wherein a plurality of the piston units are provided, the plurality of piston units are arranged in line along the axial direction of the output shaft, and the plurality of the arms are provided so as to extend in the radial directions of the cylinder from a plurality of positions in a circumferential direction and in the axial direction of the output shaft on the output shaft.

7. The rotary actuator according to claim 1, wherein the cylinder is provided with a piston chamber that houses the piston supported so as to be able to slide and be displaced with respect to the cylinder, and the piston chamber is defined by a tubular hollow member that is installed in a main body of the cylinder and extends in an arc.

* * * * *